US007588240B2

(12) United States Patent
Guaraldi et al.

(10) Patent No.: US 7,588,240 B2
(45) Date of Patent: Sep. 15, 2009

(54) SADDLE STITCHER WITH INDIVIDUAL STITCHER DRIVES

(75) Inventors: Glenn Alan Guaraldi, Kingston, NH (US); Warren Hess Jarrard, Farmington, NH (US)

(73) Assignee: Goss International Americas, Inc., Dover, NH (US)

( * ) Notice: Subject to any disclaimer, the term of this patent is extended or adjusted under 35 U.S.C. 154(b) by 217 days.

(21) Appl. No.: 11/501,306

(22) Filed: Aug. 9, 2006

(65) Prior Publication Data

US 2008/0036133 A1 Feb. 14, 2008

(51) Int. Cl.
*B65H 37/04* (2006.01)

(52) U.S. Cl. ..... 270/52.18; 270/52.14; 270/52.26; 270/52.29

(58) Field of Classification Search ..... 270/52.14, 270/52.18, 52.26, 52.29
See application file for complete search history.

(56) References Cited

U.S. PATENT DOCUMENTS

| | | | | |
|---|---|---|---|---|
| 2,810,468 | A | 10/1957 | Faeber et al. | |
| 2,827,632 | A * | 3/1958 | Faeber | 227/81 |
| 2,845,264 | A | 7/1958 | Faeber et al. | |
| 4,196,835 | A | 4/1980 | Schlough | 227/81 |
| 4,519,599 | A | 5/1985 | Mayer | 270/53 |
| 4,537,342 | A * | 8/1985 | McCain et al. | 227/78 |
| 4,708,277 | A | 11/1987 | Schlough | 227/88 |
| 5,100,118 | A | 3/1992 | Hobbs et al. | |
| 5,499,803 | A * | 3/1996 | Farr | 270/52.14 |
| 5,678,813 | A * | 10/1997 | Osako et al. | 270/52.16 |
| 5,730,436 | A * | 3/1998 | Viebach et al. | 270/52.16 |
| 5,772,195 | A * | 6/1998 | Mueller | 270/52.16 |
| 5,874,812 | A * | 2/1999 | Chang | 318/35 |
| 6,223,964 | B1 * | 5/2001 | Muller | 227/81 |
| 6,514,028 | B2 * | 2/2003 | Yeoman | 412/35 |
| 2005/0201850 | A1 * | 9/2005 | Numberger et al. | 412/35 |
| 2005/0248076 | A1 * | 11/2005 | Bottcher et al. | 270/52.18 |

* cited by examiner

*Primary Examiner*—Gene Crawford
*Assistant Examiner*—Leslie A Nicholson, III
(74) *Attorney, Agent, or Firm*—Davidson, Davidson & Kappel, LLC

(57) ABSTRACT

A saddle stitching device including a saddle-back conveyor having a first printed product location and a second printed product location adjacent the first printed product location, a first stitcher adjacent the conveyor and driven by a first motor, and a second stitcher adjacent the conveyor and driven by a second motor.

8 Claims, 2 Drawing Sheets

SADDLE STITCHER WITH INDIVIDUAL STITCHER DRIVES

BACKGROUND

The present invention relates to post-press machinery, and more specifically to saddle stitchers.

U.S. Pat. No. 4,519,599 discloses simultaneous stitching of tandem sets of 1-up gathered signatures. A shuttle mechanism grips adjacent, consecutive unbound books on a saddle-type gathering conveyor and, in a single stroke, presents both unbound books at a saddle stitcher station for simultaneous binding.

U.S. Pat. No. 5,772,195 discloses a gathering and wire stitching machine for producing magazines, booklets and similar products from folded printed sheets comprising a conveyor path including a gathering segment and an adjoining wire stitching segment, the conveyor path including a saddle-shaped support for receiving printed sheets in a straddling arrangement from feeders arranged along the gathering segment.

U.S. Pat. Nos. 4,708,277 and 4,196,835 disclose stitching devices and are hereby incorporated by reference herein.

SUMMARY OF THE INVENTION

The present invention provides a saddle stitching device comprising:

- a saddle-back conveyor having a first printed product location and a second printed product location adjacent the first printed product location;
- a first stitcher adjacent the conveyor and driven by a first motor; and
- a second stitcher adjacent the conveyor and driven by a second motor.

By providing two individual motors, the stitchers can be driven independently and as desired.

The present invention also provides a method of saddle stitching printed products comprising:

- conveying an unstitched first printed product using a conveyor past a first stitcher;
- stitching the first printed product with the first stitcher, the first stitcher being driven by a first motor;
- conveying an unstitched second printed product using the conveyor past the first stitcher without stitching the second printed product to a second stitcher; and
- stitching the unstitched second product with the second stitcher, the second stitcher being driven by a second motor.

DETAILED DESCRIPTION OF A PREFERRED EMBODIMENT

Figure 1:
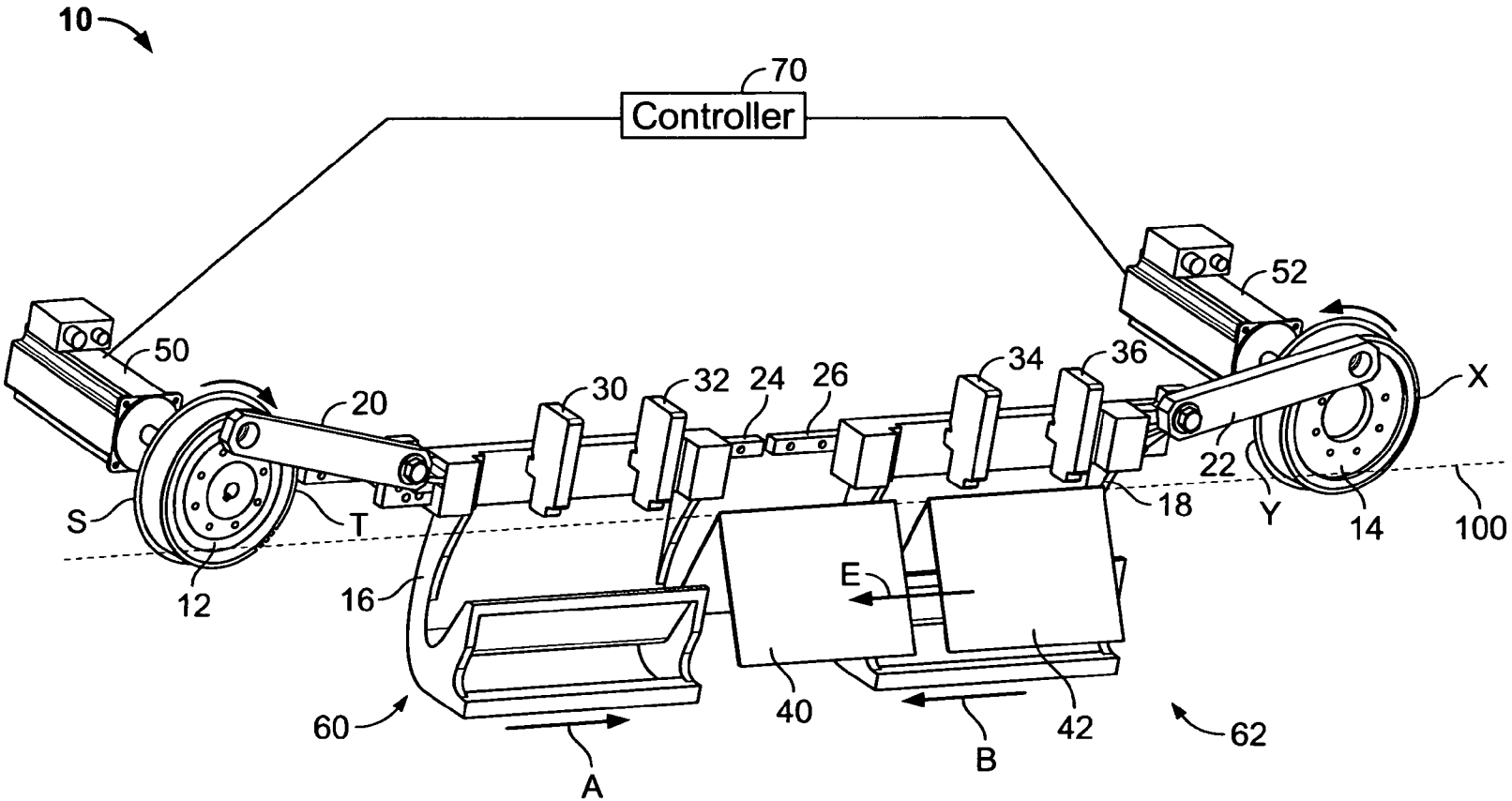
FIG. 1 shows a saddle stitcher according to the present invention stitching a first product.

FIG. 1 shows a stitcher 10. Stitcher 10 includes two stitchers 60 and 62, each driven by its own motor, i.e. independently. Stitcher 60 includes a motor 50 that drives a wheel 12. A carriage 16 is mounted on a bearing slide 24 and connected to wheel 12 by a link 20. Mounted onto carriage 16 are reciprocating stitching heads 30, 32. Any number of stitching heads may be provided, although two or three are preferable.

Stitcher 62 includes a motor 52 that drives a wheel 14. A carriage 18 is mounted on a bearing slide 26 and connected to wheel 14 by a link 22. Mounted onto carriage 18 are reciprocating stitching heads 34, 36. A controller 70 controls motors 50, 52. A first signature 40 and a second signature 42 at adjacent printed product receiving locations on a saddle-back conveyor 100 travel in a direction E across carriages 16 and 18.

The stitchers 60, 62 advantageously are not fastened together, so that they are free to move independently of each other.

Motors 52, 62 preferably are servomotors, and are capable of being phase-controlled.

Figure 2:
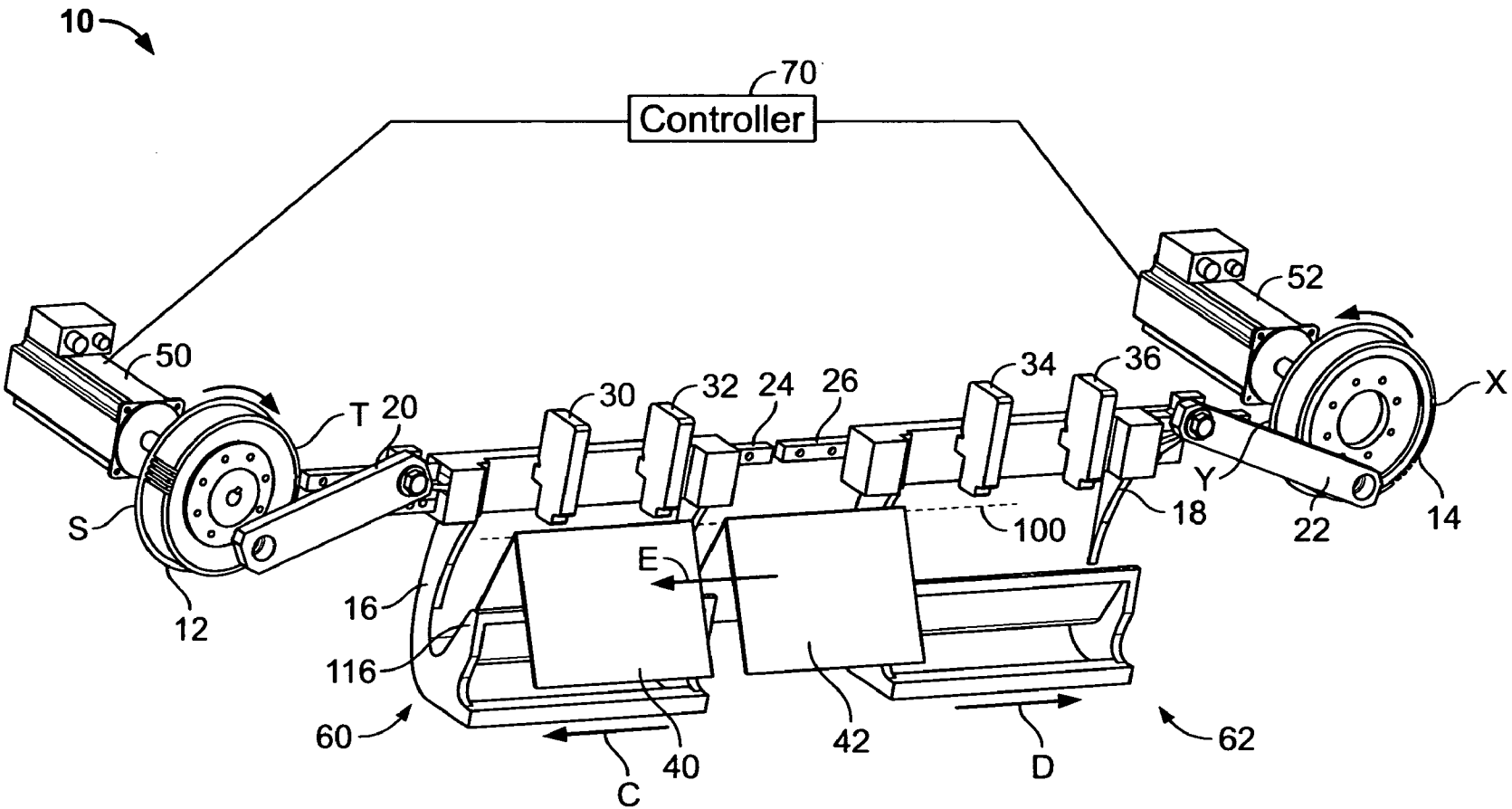
FIG. 2 show a saddle stitcher according the present invention stitching a second product.

In the embodiment of FIGS. 1 and 2, when stitcher 62 receives a signal from controller 70, motor 52 drives wheel 14 in a counterclockwise direction. Link 22, rotatably connected to wheel 14 on one end and carriage 18 on another, rotates with wheel 14. As wheel 14 rotates counterclockwise from a point X to a point Y, carriage 18 is propelled in a direction B along bearing slide 26. Carriage 18 moves in the same direction as signatures 40, 42. When a speed of carriage 18 nears a speed of signatures 42 and stitching heads 34, 36 are positioned properly, stitching heads 34, 36 are actuated and stitch signature 42. Stitching heads 34, 36 may move up and down to stitch signature 42.

Incorporated-by-reference U.S. Pat. No. 4,196,835 for example shows the details of the stitcher assembly or stitchers 50, 60, as well as the clinchers 116.

When stitcher 60 receives a signal from controller 70, motor 50 drives wheel 12 in a clockwise direction. Link 20, rotatably connected to wheel 12 on one end and carriage 16 on another, rotates with wheel 12. As wheel 12 rotates clockwise from a point S to a point T, carriage 16 is propelled in a first direction A along bearing slide 24, opposite to direction E in which signatures 40, 42 travel, so stitching heads 30, 32 do not yet stitch signature 40.

FIG. 2 shows stitcher 10 after wheels 12, 14 have rotated approximately 180 degrees. As wheel 14 continues to rotate from Point Y to Point X, link 22 pulls carriage 18 in direction D. Stitching heads 34, 36 are no longer in the position to stitch. As wheel 12 continues to rotate from Point T to Point S carriage 16 is propelled in a direction C along bearing slide 24. Now, carriage 16 moves in the same direction as signatures 40, 42. When a speed of carriage 16 nears a speed of signatures 40 and stitching heads 30, 32 are positioned properly, stitching heads 30, 32 are actuated and stitch signature 40. Stitching heads 30, 32 may move up and down to stitch signature 40.

The stitching heads may move up and down to stitch and back and forth in the direction of the saddle back conveyor as carriages oscillate, as described un U.S. Pat. No. 4,196,835.

The stitchers 60, 62 may be set to stitch approximately 180 degrees out of phase from each other, for example. However, depending on spacing and timing and the number of stitchers for example, stitchers may be run in phase at the same time, or at different phases than 180 degrees. This is achievable since the stitchers have independent drive motors and the controller 70 can set the phasing of the motors.

What is claimed is:

1. A method of saddle stitching printed products comprising:

- conveying an unstitched first printed product using a conveyor past a first stitcher;
- stitching the first printed product with the first stitcher, the first stitcher being driven by a first motor;

conveying an unstitched second printed product using the conveyor past the first stitcher without stitching the second printed product to a second stitcher;

stitching the unstitched second product with the second stitcher, the second stitcher being driven by a second motor; and controlling a phase of the first motor with respect to the second motor with a controller.

2. The method of saddle stitching printed products as recited in claim 1 wherein the step of controlling a phase of the first motor with respect to the second motor includes controlling the phase of the first motor so that the first stitcher is set to stitch 180 degrees out of phase from the second stitcher.

3. The method of saddle stitching printed products as recited in claim 1 wherein the step of controlling a phase of the first motor with respect to the second motor includes controlling the phase of the first motor so that the first stitcher and the second stitcher are set to stitch at a same time.

4. The method of saddle stitching printed products as recited in claim 1 wherein the step of controlling a phase of the first motor with respect to the second motor includes driving the first motor in a clockwise direction and driving the second motor in a counterclockwise direction.

5. A saddle stitching device comprising:

a saddle-back conveyor having a first printed product location and a second printed product location adjacent the first printed product location;

a first stitcher adjacent the conveyor and driven by a first motor, the first motor being connected to a link and the first stitcher including a carriage connected to the link;

a second stitcher adjacent the conveyor and driven by a second motor; and a controller for controlling the first and second motors, the controller controlling a phase of the first motor with respect to the second motor.

6. The saddle stitching device as recited in claim 5 wherein the carriage is mounted on a bearing slide.

7. The saddle stitching device as recited in claim 5 wherein the first motor drives a wheel that is connected to the link.

8. The saddle stitching device as recited in claim 5 wherein the carriage includes a clincher.

* * * * *